United States Patent [19]

Horiuchi

[11] Patent Number: 4,832,585

[45] Date of Patent: May 23, 1989

[54] ROLLER PUMP HAVING FORCE TRANSMITTING MEANS

[75] Inventor: Kunio Horiuchi, Fujinomiya, Japan

[73] Assignee: Terumo Kabushiki Kaisha, Tokyo, Japan

[21] Appl. No.: 911,869

[22] Filed: Sep. 26, 1986

[30] Foreign Application Priority Data

Sept. 27, 1985 [JP] Japan ..... 60-147383

[51] Int. Cl.[4] ..... F04B 43/12

[52] U.S. Cl. ..... 417/477

[58] Field of Search ..... 417/477, 476, 475, 104; 384/147, 148

[56] References Cited

U.S. PATENT DOCUMENTS

| | | | |
|---|---|---|---|
| 3,104,918 | 9/1963 | Horan et al. | 384/147 |
| 3,762,836 | 10/1973 | De Vries | 417/477 |
| 4,558,996 | 12/1985 | Becker | 417/477 |
| 4,702,679 | 10/1987 | Malbec | 417/477 |

*Primary Examiner*—Leonard E. Smith
*Assistant Examiner*—Leonard P. Walnoha
*Attorney, Agent, or Firm*—Burns, Doane, Swecker & Mathis

[57] ABSTRACT

A roller pump is provided with a driving mechanism; a rotating shaft rotatably driven by the driving mechanism; a pump head that includes a sleeve which is unrotatably arranged in the outer periphery of the rotating shaft, and through which the rotating shaft is inserted, and a cylindrical stator fixed outwardly and radially to the sleeve and coaxially with the same; a tube for fluid transfer supported on the inner peripheral surface of the stator; a rotor rotatably fitted with the outer periphery of the sleeve of the pump head and including at least one rotatable roller opposite to the stator; the tube being clamped between the roller and the stator; and transmitting mechanism for transmitting rotation force for the rotating shaft to the rotor.

10 Claims, 3 Drawing Sheets

ROLLER PUMP HAVING FORCE TRANSMITTING MEANS

BACKGROUND OF THE INVENTION (1) Field of the Invention

The present invention relates to a roller pump for fluid transfer, such as blood circulation, dialytic fluid circulation or fluid medicine injection, and more particularly, to an improved roller pump with high rotational accuracy, compactness in size and excellent durability.

(2) Description of the Prior Art

In general, roller pumps are simply structured and generate constant flow, and employ disposable tubes as a member for fluid transfer; these advantages make them ideal for us as a fluid transfer devices for blood circulation circuits, dialytic fluid circulation circuits or injecting apparatuses for fluid medicines.

A conventional roller pump 10, as shown in FIG. 1, comprises a drive mechanism 14 furnished with a drive shaft 12, a rotating shaft 16 which rotates according to the rotation of drive shaft 12, and a hollow pump head 20 fixed to a housing 18 to which drive mechanism 14 is attached. This pump head 20 integrally incorporates a bearing block 24 through which rotating shaft 16 is inserted and rotatably supported by a pair of bearings 22 and a stator 26 arranged to the upper portion of bearing block 24. On the upper surface of stator 26 is formed a recess 28 through which the upper end of rotating shaft 16 is protruded. While this recess 28 is radially and outwardly spaced at a certain distance from the outer circumferential surface of rotating shaft 16, its inner circumferential surface 28*a* is coaxial with rotating shaft 16.

Rotor 30 is attached to the upper portion of rotating shaft 16 in such a way as to be placed inside recess 28 of stator 26 and to stay opposite the inner circumferential surface 28*a* thereof. This rotor 30 is fixed to rotating shaft 16 through a bolt 32, and is so constructed as to integrally rotate along with rotating shaft 16. On the outer circumferential surface of rotor 30, at least one roller 34 is arranged so as to rotate around its own axes. A tube 36 which is filled with blood or other fluid materials is placed between rotor 30 and stator 26. Tube 36 is clamped between respective rollers 34, which are attached to rotor 30, and inner circumferential surface 28*a* of stator 26, thereby maintaining tube 36 in a closed state at the point at which it is clamped.

Thus, in a conventional roller pump 10, rotor 30 is rotated by the rotational motion of rotating shaft 16 driven by drive mechanism 14, and the clamped portions of tube 36 move according to the revolution of rollers 34 around rotating shaft 16. Therefore, fluid inside tube 36 is transferred according to the revolution of rollers 34. It is to be noted that by the revolution of roller 34, tube 36 comes off easily after being clamped between rollers 34 and inner circumferential surface 28*a* ; in order to prevent this, tube guides 38 are provided which hold tube 36 in position.

In these roller pumps of conventional construction, rotor 30 is attached to rotating shaft 16 by an open-sided supporting structure. Therefore, when rollers 34 close tube 36, a reaction force perpendicular to the axis of rotating shaft 16 occurs. Rotating shaft 16 is thereby bent by this force, and when rotated in this state, swing tends to occur.

Under these conditions, if rotating shaft 16 swings, the clearance between each roller 34 and inner circumferential surface 28*a* varies, thus causing unevenness in the closed state of tube 36. This causes the stable transfer of the fluid to deteriorate, and durability of roller pump 10 is shortened.

Consequently, the following two measures to prevent the swing of rotating shaft 16 are considered:

(1) rotor 30 is attached to rotating shaft 16 by a both-sided supporting structure;

(2) while keeping an open-sided supporting structure, the shaft diameter is increased, and large-bore bearings of high durability are employed in order to increase the rigidity of rotating shaft 16.

Considering the measures mentioned above; in measure (1), the construction of the pump becomes complicated, and furthermore attaching and detaching the tube to the clearance between rotor 30 and stator 26 becomes difficult, which is far from practical to use. This eventually leads us to choose measure (2).

In measure (2) as mentioned above, however, although the swing of rotating shaft 16 is prevented, the shaft diameter of rotating shaft 16 becomes large and the bore of the bearing is also increased, resulting in a total increase in both the size and the weight of the roller pump.

SUMMARY OF THE INVENTION

The present invention is contrived in the light of the circumstances mentioned above; and the object of the present invention is to provide a high-performance, compact roller pump of excellent durability that prevents swing in the rotating shaft.

In order to attain the object mentioned above, the roller pump according to the present invention comprises driving means; a rotating shaft rotatably driven by said driving means; a pump head that includes a sleeve which is unrotatably arranged on the outer periphery of said rotating shaft, and through which said rotating shaft is inserted, and a cylindrical stator fixed outwardly and radially to said sleeve and coaxially with the same; a tube for fluid transfer supported on the inner peripheral surface of said stator; a rotor rotatably fitted to the outer periphery of said sleeve of said pump head and including at least one rotatable roller opposite said stator; said tube being clamped between the roller and the stator; and means for transmitting the rotation force of the rotating shaft to said rotor.

Namely, according to the present invention, the need for aforementioned measures (1) and (2) is completely obviated, and as a result an improved roller pump which can respectively sustain the rotating force of the rotor and a reaction force perpendicular to the axis of the rotating shaft to different members is achieved. Accordingly, the improved roller pump has succeeded in eliminating the swing in the rotor, which is unavoidable in conventional roller pumps.

BRIEF DESCRIPTION OF THE DRAWINGS

FIG. 4 is a vertical section view showing a second embodiment of the roller according to the invention.

DESCRIPTION OF THE PREFERRED EMBODIMENT

Figure 1:
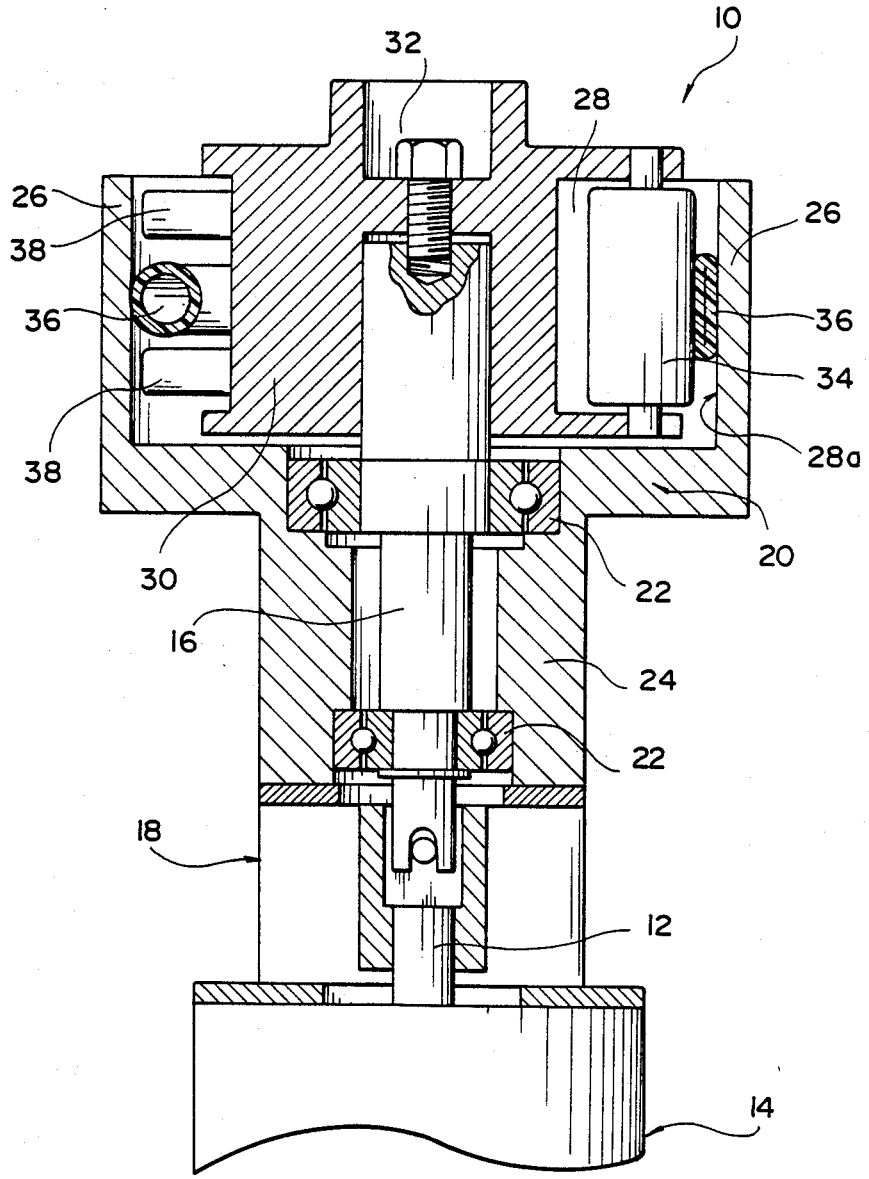
FIG. 1 prior art
FIG. 1 is a vertical section view showing a conventional roller pump.
Figure 2:
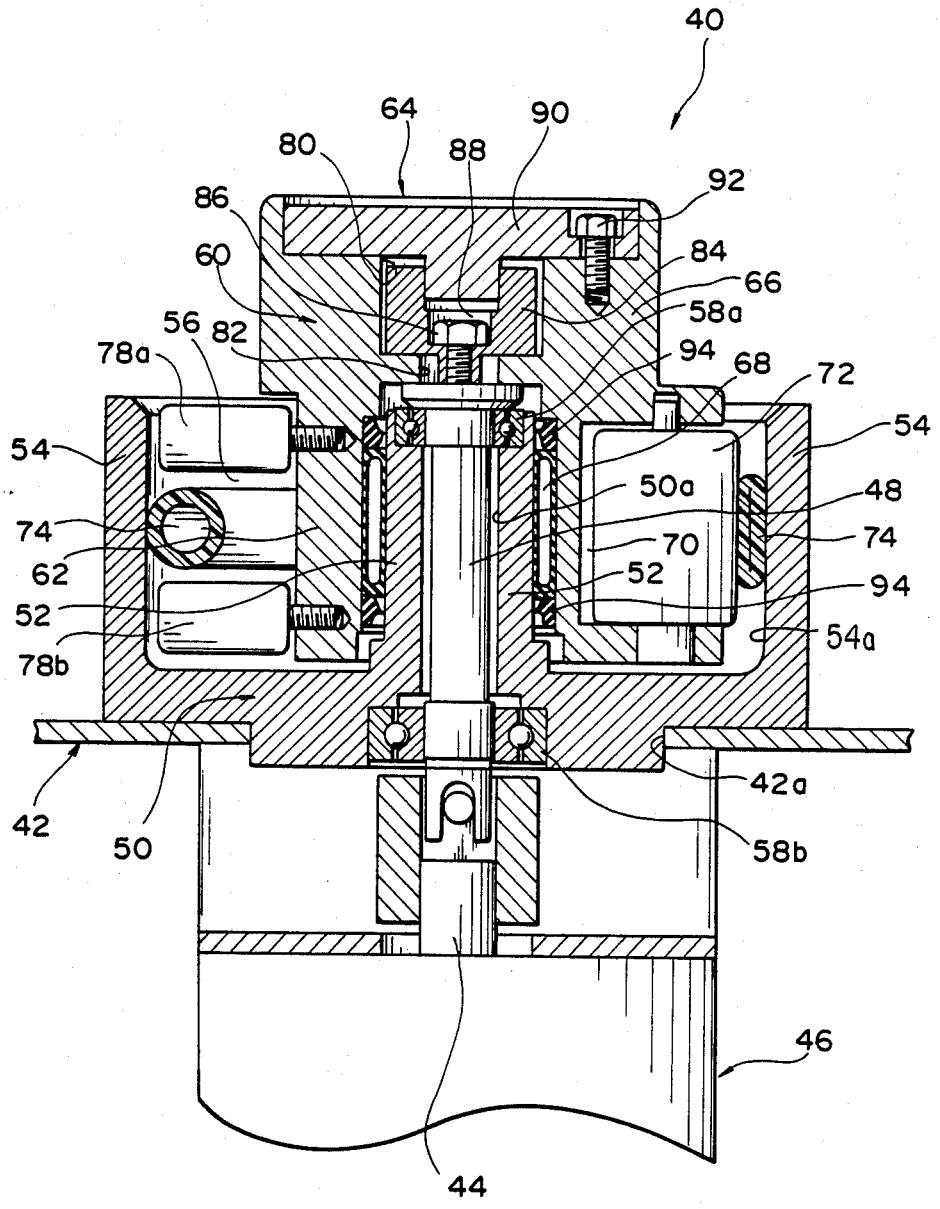
FIG. 2 is a vertical section view showing one embodiment of the roller pump according to the present invention.

Referring to the attached drawings of FIG. 2 and FIG. 3, one embodiment of the roller pump according to the present invention will now be described in detail.

A roller pump 40 is provided with a housing 42 and a drive mechanism 46 which has a driving shaft 44 rotated around the vertical axis on its upper portion and which is attached to the under surface of the upper portion of housing 42. A rotating shaft 48, protruding through a through-hole 42*a* formed in housing 42, is integrally connected to drive shaft 44 so that they rotate together. Although not shown in detail, drive mechanism 46 includes a drive motor and a reduction gear train which reduces and transmits the driving force from the drive motor to drive shaft 44.

A pump head 50, being provided with a hollow portion 50*a* that extends vertically, is attached to the upper surface of housing 42. Pump head 50 is provided with a sleeve 52 which has hollow portion 50*a* protruding upwardly in the center, and a cylindrical stator 54 protruding upwardly coaxially with sleeve 52 in the outer periphery. In other words, pump head 50 is so formed as to be provided with a doughnut-shaped recess between sleeve 52 and stator 54.

The aforementioned rotating shaft 48 is inserted in hollow portion 50*a* of pump head 50, or in other words inside sleeve 52, so that its upper end extends from the upper portion of pump head 50. It is noted that that portion of rotating shaft 48 which is located inside sleeve 52 is rotatably supported by a pair of bearings 58*a* and 58*b*.

On the upper end of rotating shaft 48, a rotor 60 is coaxially attached to stator 54. Rotor 60 is integrally provided with a roller supporting portion 62 which is formed downwardly along the outer periphery of sleeve 52, and a fixing portion 66 located on the top of supporting portion 62, and fixed to rotating shaft 48 by way of a transmitting mechanism 64 that transmits the rotation force of rotating shaft 48. A bearing 68 is provided between sleeve 52 and roller supporting portion 62. Roller supporting portion 62 and rotor 60 are rotatably supported to sleeve 52 by means of bearing 68. In this way, by rotatably supporting rotor 60 through sleeve 52, the reaction force which occurs when a tube 74 (described hereinafter) is clamped is not directly transmitted to rotating shaft 48.

On the outer periphery of roller supporting portion 62 of rotor 60 are formed three recesses 70 (In FIG. 2, only one recess is shown) at the same intervals. While being received partially, a roller 72 is rotatably supported around the vertical axis at each recess 70. Between rotor 60 and stator 54, a tube 74 filled with such fluids as blood or dialytic liquids is clamped. In particular, those portions of tube 74 which are clamped between rollers 72 and roller supporting portion 62 are forced shut by rollers 72, and the sections on either side of the points at which tube 74 is clamped are isolated from each other by the clamped portion.

Figure 3:
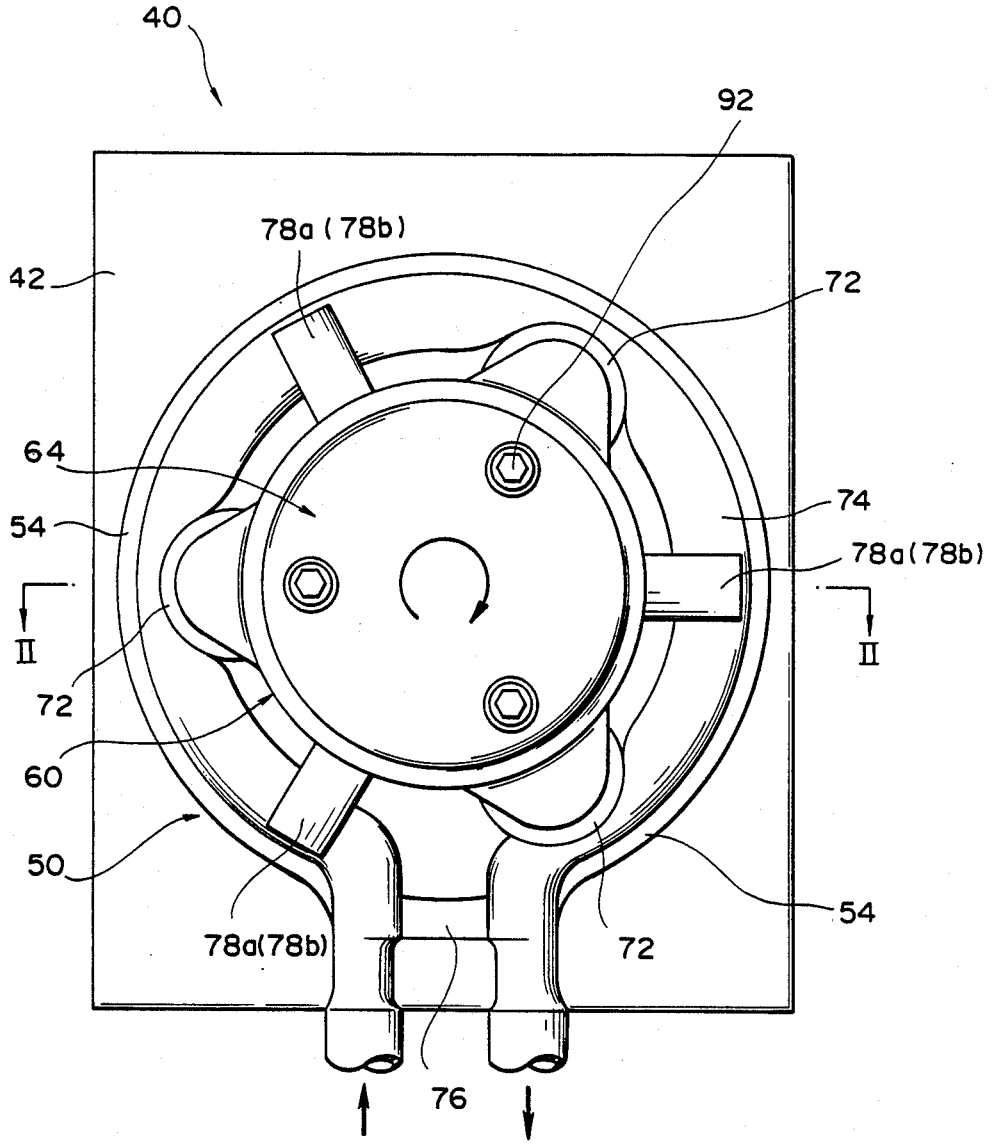
FIG. 3 is a plan view showing the roller pump shown in FIG. 2.

As shown in FIG. 3, on one portion of stator 54, a groove 76 is formed to guide tube 74 between stator 54 and recess 56. The width of groove 76 is defined such that tube 74 is always closed by at least one roller 72.

In order to prevent tube 74 supported between stator 54 and rotor 60 from disengaging from the engaged state when unexpected deformation occurs, three pairs of tube guides 78*a* and 78*b* are provided. Each pair of tube guides 78*a* and 78*b* above and below tube 74 is arranged in order to regulate the vertical movement of tube 74, and as shown in FIG. 3, is located between two adjoining rollers 72.

Transmitting mechanism 64 for transmitting the rotating force of rotating shaft 48 to rotor 60 is constructed as follows: a hole 80 with deformed section is formed in the center of rotor 60 for connecting rotor 60 and rotating shaft 48. On the base of hole 80, a through hole 82 is formed. A first rigid coupling 84 is inserted to transmit the rotating force. In the center of first coupling 84, a stepped through hole 88 is provided through which a mounting bolt 86 is formed. First coupling 84, is attached to the upper surface of rotating shaft 48 by means of this mounting bolt 86, thus being fixed to rotating shaft 48.

On the upper portion of first coupling 84, a second rigid coupling 90 is fitted so that respective rotating force is transmitted. Second coupling 90 is fixed to rotor 60 by using a plurality of bolts, for example three mounting bolts 92. In this way, rotor 60 is integrally fixed to rotating shaft 48 through transmitting mechanism 64.

The first coupling member 84 couples rotor 60 to shaft 48 and prevents the rotor from moving in either, opposite direction parallel to the axial direction of the shaft.

Furthermore, to prevent foreign matter from reaching bearing 68 which is arranged between sleeve 52 of pump head 50 and roller supporting portion 62 of rotor 50, a seal ring 94 is provided on both ends of bearing 68.

Following is the explanation of the present roller pump 40 with respect to how it operates when constructed as mentioned above.

When rotating shaft 48 is driven by drive mechanism 46, rotating force is transmitted to rotor 60 through first coupling 84 and second coupling 90 of transmitting mechanism 64, and rotor 60 starts to rotate clockwise as shown by the arrow X in FIG. 3. On the other hand, fluid transfer tube 74 is installed between inner periphery 54*a* of stator 54 and the outer pheriphery of rotor 60, further tube 74 is partially clamped shut in at least two spots by rollers 72. Consequently, by the clockwise rotation of rotor 60, rollers 72 rotate around their own axes as well as revolving around rotating shaft 48, and tube 74 is squeezed clockwise by rollers 72 which rotate and revolve. In other words, those portions of tube 74 which are clamped by rollers 72 are moved clockwise by rollers 72 which rotate and revolve, and fluids inside tube 74 are therefore transferred clockwise. It is noted that those portions of tube 74 over which rollers 72 have been passed return to their original shape by their own elasticity.

Tube guides 78*a* and 78*b* respectively guide the upper and lower portions of tube 74 which is squeezed by rollers 72. Consequently, up and down dislocation of tube 74 accompanying the rotation of rotor 60 is completely prevented.

In roller pump 40 mentioned above, rotor 60 receives the reaction force from clamped tube 74 when clamped by roller 72. By the use of roller supporting portion 62, however, rotor 60 is supported by sleeve 52 of pump head 50 with sufficient rigidity and strength. Therefore, the reaction force mentioned above does not act against rotating shaft 48, and swing is prevented in rotating shaft 48.

Furthermore, rotating shaft 48 and rotor 60 are elastically connected to each other with a loose fit through first coupling 84 and second coupling 90 of transmitting mechanism 64. Therefore, rotating shaft 48 only receives the reaction force generated when the rotation force is transmitted, so the reaction force received by rotor 60, or in other words the force perpendicular to rotating shaft 48, does not apply. Accordingly, the diameter of rotating shaft 48 is minimized, and it is possible to minimize the size of bearings 58*a* and 58*b* that support rotating shaft 48.

As described above, according to one embodiment of the present roller pump 40, it is possible to obtain the following advantages:

(1) Because rotor 60 of roller pump 40 is supported by sleeve 52 with sufficient rigidity and strength, the reaction force that rotor 60 receives or the force perpendicular to rotating shaft 48 does not directly act on rotating shaft 48. Therefore, swing does not occur around rotating shaft 48, and further the degree of clamping of tube 74 does not vary according to the rotation of rotor 60. This eventually ensures that tube 74 is definitely clamped by roller 72. Consequently, the flow of the transferred fluid by roller pump 40 is stabilized, and in addition, high pump efficiency is maintainable.

In particular, roller pump 40 as one embodiment of the present invention can maintain an ideal clamped state in tube 74. When used as a pump for blood circulation, the degree of clamping of the tube can be maintained at a lower level, preventing the breakdown of suspended particles in the blood and making the inventive pump ideal as a blood circulation pump.

(2) In roller pump 40, rotating shaft 48 is connected to rotor 60 with a loose fit through transmitting mechanism 64. Therefore, only the reaction force that accompanies by the rotation acts on rotating shaft 48, and the reaction force that is generated when roller 72 clamps tube 74 does not act on rotating shaft 48. Thus it becomes possible to employ a smaller shaft diameter for rotating shaft 48 and to maintain durability by adopting smaller bearings 58*a* and 58*b* for supporting rotating shaft 48. The design of a smaller and lighter roller pump 40 thus becomes possible in this manner.

(3) In roller pump 40, rotating shaft 48 is supported by sleeve 52 attached to pump head 50. There is no need to furnish a shaft supporting bearing block extending from the lower portion of the stator, which is often the case with conventional roller pumps, and therefore the inventive roller pump can be made axially shorter.

According to the present invention, various embodiments within the range of the contents mentioned above are possible.

For example, in one embodiment mentioned above, although the first and second couplings 84 and 90 are made of rigid materials, they could be made of elastic materials as shown in FIG. 4. Where couplings are made of elastic materials, the reaction force acting upon the rotor, which occurs when the tube is clamped, is absorbed by these couplings, and the effect is further maximized.

Further, in one embodiment mentioned above, though pump head 50 is integrally provided with sleeve 52 and stator 54, the construction is not restricted in this manner alone. Each part may be individually constructed and integrally and fixedly connected and attached to each other.

Furthermore, as long as dislocation of tube 74 or in other words up and down dislocation from the axis of rotating shaft 48 is prevented, tube guides 78*a* and 78*b* may be constructed in a different way from those mentioned above. Preferably, the tube guide functions as a guide roller using an idle roller.

In one embodiment mentioned above, though the tube guides are constructed by a pair of upper and lower guides, the construction is not restricted by this alone, and an other construction provided with an upper guide alone is also possible.

What is claimed is:

1. A roller pump which transfers fluid into a tube, comprising:

driving means;

a shaft rotatably drivable by said driving means;

a pump head including a sleeve unrotatably arranged on the outer periphery of said shaft, and through which said shaft extends, and a cylindrical stator fixed outwardly and radially to said sleeve and coaxially with said sleeve;

a rotor rotatably fitted to the outer periphery of said sleeve of said pump head and including at least one rotatable roller opposite said stator;

said tube being supported on the inner peripheral surface of said stator and being clamped between the roller and the stator; and rotational force transmitting means for transmitting the rotational force of the rotating shaft to said rotor, said rotational force transmitting means including a first coupling member for coupling said rotor to said shaft and for preventing said rotor from moving in either, opposite direction parallel to the axial direction of said shaft, said first coupling member being fixed to said shaft, and a second coupling member connected between said first coupling member and said rotor to prevent said rotor from rotating relative to said shaft, said rotor being rotatable relative to said first coupling member and said shaft when said second coupling member is removed from the roller pump.

2. The roller pump according to claim 1, wherein said first and second coupling members are made of rigid materials.

3. The roller pump according to claim 1, wherein said first and second coupling members are made of elastic materials.

4. The roller pump according to claim 1, wherein said sleeve and said stator are integrally formed in said pump head.

5. The roller pump according to claim 1, wherein said sleeve has a through-hole through which the shaft extends, an upper end of said shaft protruding through said through-hole.

6. The roller pump according to claim 5, wherein said first coupling member is fixed to said upper end of the shaft.

7. The roller pump according to claim 1, wherein said pump head includes a recess formed between the outer periphery of said sleeve and the inner periphery of said stator, said roller being arranged in said recess.

8. The roller pump according to claim 1, wherein said rotor is rotatably supported on said sleeve by bearings.

9. The roller pump according to claim 1, wherein the upper and lower end of said bearings are sealed by seal rings.

10. The roller pump according to claim 1, wherein said shaft is supported within said sleeve by a pair of spaced bearings.

* * * * *